United States Patent [19]

Pazderka

[11] 3,979,939

[45] Sept. 14, 1976

[54] APPARATUS FOR THE MOUNTING AND REMOVAL OF THE ROLLERS OF A ROLL STAND

[75] Inventor: Cyril Pazderka, Meerbusch, Germany

[73] Assignee: G. Schwartz & Co., Dusseldorf, Germany

[22] Filed: May 12, 1975

[21] Appl. No.: 576,289

[30] Foreign Application Priority Data

May 21, 1974 Germany ..... 2424659

[52] U.S. Cl. ..... 72/239

[51] Int. Cl.[2] ..... B21B 31/08

[58] Field of Search ..... 72/239, 238

[56] References Cited

UNITED STATES PATENTS

| | | | |
|---|---|---|---|
| 3,323,345 | 6/1967 | Lyle et al. | 72/239 |
| 3,559,441 | 2/1971 | Lemper et al. | 72/239 |
| 3,635,066 | 1/1972 | Schmiedberg | 72/239 |
| 3,638,468 | 2/1972 | Fukui | 72/239 X |

*Primary Examiner*—Milton S. Mehr

*Attorney, Agent, or Firm*—Martin A. Farber

[57] ABSTRACT

An apparatus for the insertion and withdrawal of the rollers of a roll stand with a transfer car which is moveable in the roller direction, the rollers from the side in a horizontal position being pushed into the roll stand and withdrawn from the roll stand. A coupling drive is arranged on the transfer car, which drive comprises at least two equally long carrier arms which are coupled with each other over a cycloid transmission. A clamping head is arranged at the front free end of the carrier arms for the clamping and horizontal movement of the rollers on their mounting journals. A straight line guide device for the clamping head is arranged parallel to the cycloid transmission on the carrier arms.

9 Claims, 7 Drawing Figures

APPARATUS FOR THE MOUNTING AND REMOVAL OF THE ROLLERS OF A ROLL STAND

The present invention relates to an apparatus for mounting and removing the rollers of a roll stand with a transfer car which is moveable in a roller direction, by which the rollers are pushed in the roll stand in a horizontal direction from the side and withdrawn from the roll stand, respectively.

An apparatus for exchanging the operating rollers of a roll stand is known from German Auslegeschrift No. 1,913,771, comprising a roller removal car which is moveable in the axial direction of the operating rollers and arranged before the roll stand, and a roller receiver which is moveable in the roller direction and arranged between the roll stand and the roller removal car; wherein, the roller removal car preferably has two removal couplings or sleeves for the acceptance of the operating rollers to be exchanged and is mounted from a downwardly lowerable or pivotable platform which is arranged at the level of the foundry floor during the exchanging of the operating rollers; and the platform is provided with at least one hydraulic piston-cylinder-arrangement and under circumstances with a cover plate for the lowering and pivoting, respectively, which provides an accessible surface of the foundry floor after the lowering and pivoting, respectively. With this known apparatus the roller receiver comprises at least two places of deposit of the rollers, which are formed as accessible guide plates arranged in the axial direction of the operating rollers in front of the roll stand with deposit blocks which are vertically adjustably provided with hydraulic piston-cylinder arrangements. With this known apparatus, thus there is coordinated to each roll stand an individual or particular roller removal car which is raised with a hydraulic piston-cylinder-arrangement for the exchange of the operating rollers and after the exchange is again lowered. This known apparatus requires a very high expense, since for every roll stand an individual roller removal car with the corresponding hydraulic is necessary. In addition, near the roller receiver which is moveable in the roller direction sufficient space must yet be available for disposal for the positioning of the roller removal car underneath the foundry floor. From the last mentioned basis, it is not possible as a rule to equip the roll stands of an already existing roller street or passageway with the known apparatus for exchange of the operating rollers.

There is known from the German Auslegeschrift No. 1,602,143 another apparatus for the horizontal insertion and removal of the rollers of a roll stand, with slide elements provided for driving out the rollers, the slide elements being on the roll stand support and on the roller insertion pieces and a horizontal table arranged laterally at the rolling mill, which table has rails which can be brought in the extended axis of the slide elements and is provided with a carriage or sled driven by means of an endless chain, the carriage being provided with a gripping means or clasp for the roller change. With this known apparatus, for the lifting and lowering of the table, angle levers are articulated with their one leg end in a lower and upper roller removal plane, pivotally supported at their center of gravity and articulated with their other leg end on a hydraulic pivot cylinder. For use of this known apparatus it is necessary to support the rollers with slide elements provided for the driving out on the roll stand support. On this basis it is not possible to use the known apparatus also for roll stands of an already existing roller passageway.

The two previously described known apparatuses for the exchange of the operating rollers of a roll stand have the common disadvantage that the exchange or replacement process per roll stand lasts too long.

The present invention is based on the task and object to produce an apparatus for the installation and removal of the rollers of a roll stand, which itself is moveable in the roller direction and by which the rollers of different roll stands can be installed and removed in a narrow space and in a short time. Further, it is a task and object on which the invention is based to eliminate the disadvantages of the state of the art.

Starting out from a known apparatus for the insertion and withdrawal of the rollers of a roll stand with a transfer car which is moveable in the roller direction, whereby the rollers are pushed in from the side in the roll stand in a horizontal position and are withdrawn from the roll stand, respectively, the for example, one task and object on which the present invention is based is solved by a carrier or coupling drive which is rotatable about a vertical axis and arranged on the transfer car, which drive comprises at least two pairs of equally long inner and outer arms carrier arms which are coupled with each other over a cycloid transmission, by a clamping head for clamping or seizing, and horizontal movement of the rollers on their mounting journals, the clamping head being preferably arranged at the front free end of the carrier arms. The inner carrier arms are mounted on a common shaft, the latter being secured to the outer carrier arms. The inner carrier arms are spaced apart and secured in supports, and a pivot drive operatively connects the inner carrier arms by a straight line guide device for the clamping head, which device is arranged parallel to the cycloid transmission on the carrier arms.

By a practical embodiment form of the invention, in accordance with another object thereof, the coupling drive can comprise two pairs of carrier arms, which are arranged spaced from each other and parallel to each other, so that the clamping head can be mounted on a moveable axle connecting the front carrier arms with each other. With this embodiment example, the two inner carrier arms are supported on axles which are separate from each other, the axles being secured in pedestals, such that between the axles sufficient space remains free for the swinging-in of the front carrier arms with the clamping head secured thereon carrying the rollers. The pivot joint between the outer carrier arms and the inner carrier arms constitutes a common shaft, with which the outer carrier arms are non-rotatably connected relative thereto and on which the inner carrier arms are rotatably mounted.

The cycloid transmission coordinated to each pair of the carrier arms suitably comprises a chain or sprocket wheel secured on the fixed axle, and a sprocket wheel secured on the shaft, which are connected with each other by means of chain drives and the radii of which are 2:1 with respect to each other. The carrier arms are moved with a hydraulic pivot drive which comprises a cylinder, a pivot lever, a pivot shaft and a chain drive, respectively.

The straight line guide device for the clamping head suitably comprises a sprocket wheel secured on the fixed axle, two (twin) sprocket wheels connected with each other and supported on the shaft, and a sprocket wheel secured on the front moveable axle (or trunnion for the guide of the clamping head), which are connected with one another by chain drives, and the radii of which are 1:1:1 with respect to one another. The kinematic connection between the cycloid transmission for the two carrier arms and the straight line guide device for the clamping head causes the clamping head to move back and forth on a horizontal line during the movement of the carrier arms. Consequently, the rollers can be pushed in the roll stand and withdrawn from the roll stand, respectively, in horizontal position.

In order to be able to adjust the clamping head to the height of the mounting trunnions of the rollers, it has proven suitable to vertically moveably support the clamping head in a guide secured on the moveable axle, whereby the height adjustment is brought about by means of two hydraulic cylinders. In the clamping head itself there are arranged two lateral clamping cylinders as well as an upper and a lower clamping cylinder for gripping the mounting trunnions of the rollers. Therefor, the clamping pistons of the central clamping cylinders each possess two clamping seats which engage the mounting trunnions of the upper and lower rollers.

In a further embodiment of the invention, it has proven suitable to rotatably arrange the coupling drive on the transfer car in such a manner that the rollers which are withdrawn from the roll stand swing about 180°and can be deposited on the side of the transfer car opposite to the roll stand, on a support provided therefor or a car. The transfer car then is moved to receive and mount a new roller in a type of "pilgrim step movement" or "step-back movement", i.e., at first being moved forward and then back.

The outstanding advantage of the apparatus constructed in accordance with the present invention for the insertion and removal of the rollers of a roll stand, resides in that the rollers, in horizontal position in the narrowest space, can be withdrawn from the roll stand, turned about 180°, and again deposited on the side opposite the roll stand. A further advantage resides in that the apparatus according to the invention operates solely above the foundry or cast floor and, consequently can be used without great expense yet also on already existing roller streets. Finally, there exists the advantage that the loss of time required for changing the rollers is kept to a minimum by the "pilgrim step movement" possible with the apparatus mounted on a transfer car and constructed in accordance with the invention. The present customary long shut down times of the entire roller street are considerably reduced in this manner.

With the above and other objects in view, the present invention will be more readily understood in the following detailed description of a preferred embodiment of an apparatus in accordance with the present invention for the mounting and withdrawal of the rollers of a roll stand, with reference to the accompanying drawings, of which:

Figure 1:
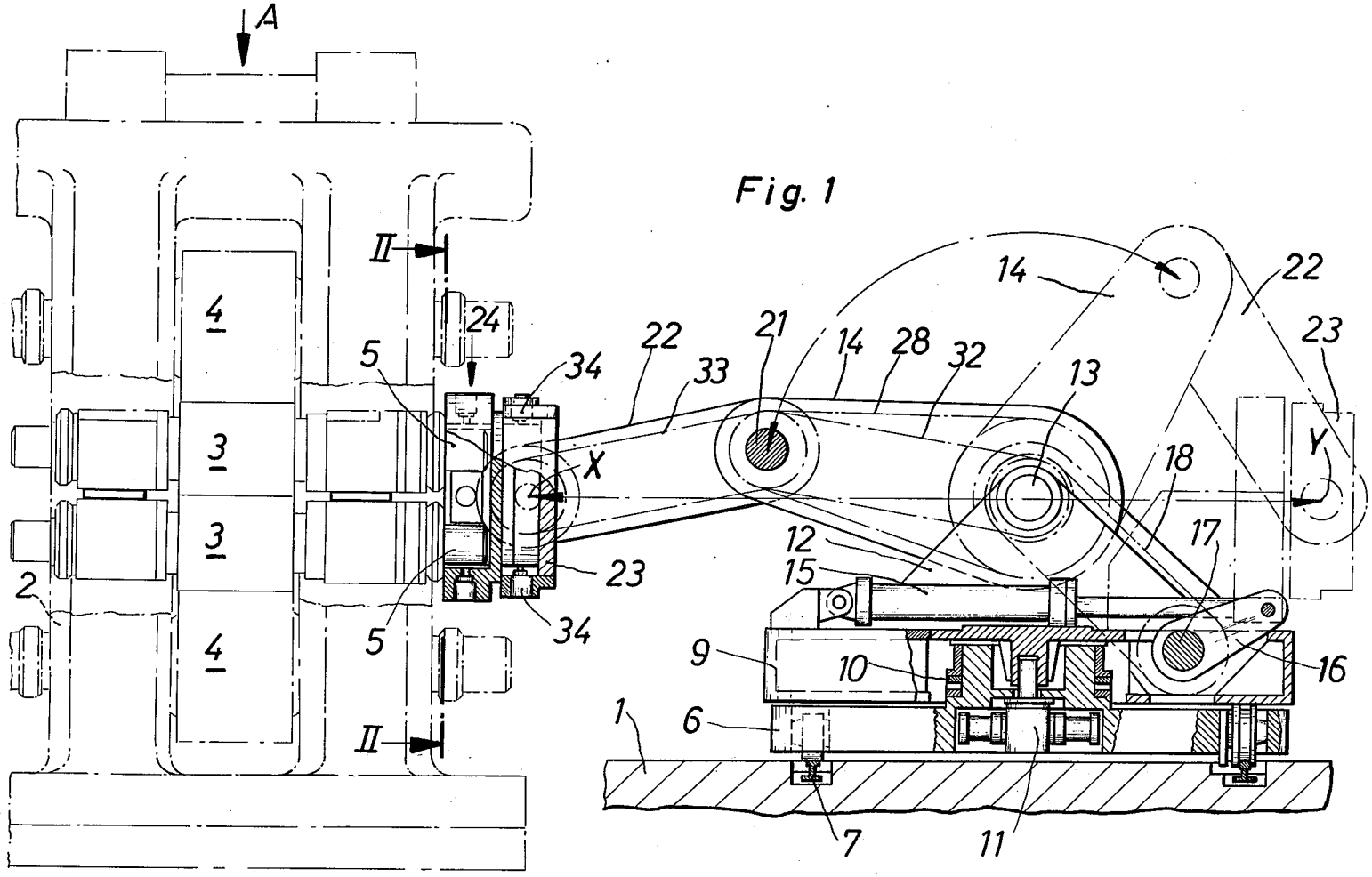
FIG. 1 is a side view, partly broken away and in section, of an apparatus in accordance with the invention with clamping head applied to the operating rollers of a roll stand (the latter being shown in dashed lines)
Figure 7:
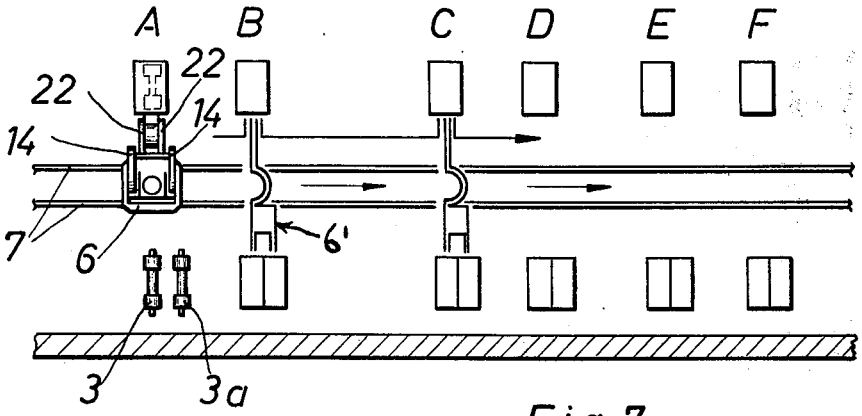
FIG. 7 is an operating schematic plan view for the "pilgrim step movement" of the apparatus in accordance with the invention.

Referring now to the drawings, and more particularly to FIG. 7, a plurality of roll stands A, B, C, D, E, F arranged one behind the other in roller direction on the cast or foundry floor 1 form a roller street or passageway. As shown in FIG. 1, the roll stand A comprises a roll housing 2, operating rollers 3 and support or backup rollers 4, and in particular not illustrated insert pieces for the operating rollers 3 and the support rollers 4. The operating rollers 3 are provided with mounting journals or trunnions 5, on which they can be clamped and in horizontal direction from the side, pushed in the roll stand A, and withdrawn from the latter, respectively.

Figure 4:
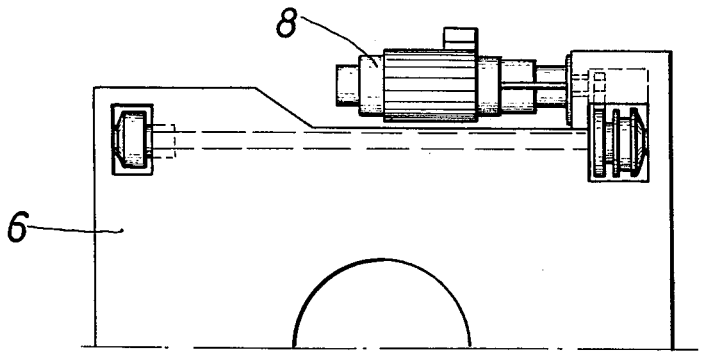
FIG. 4 is a top plan view of a drive for the transfer car.

The apparatus according to the invention for inserting and removing the working rollers 3 is arranged alongside the roll stands A to F with a transfer car 6 which is moveable on rails 7, the latter being set in the foundry floor 1. The transfer car 6 is moveable, in rapid motion or slow motion, by a drive motor 8 (FIG. 4) with return movement interruption means.

Figure 2:
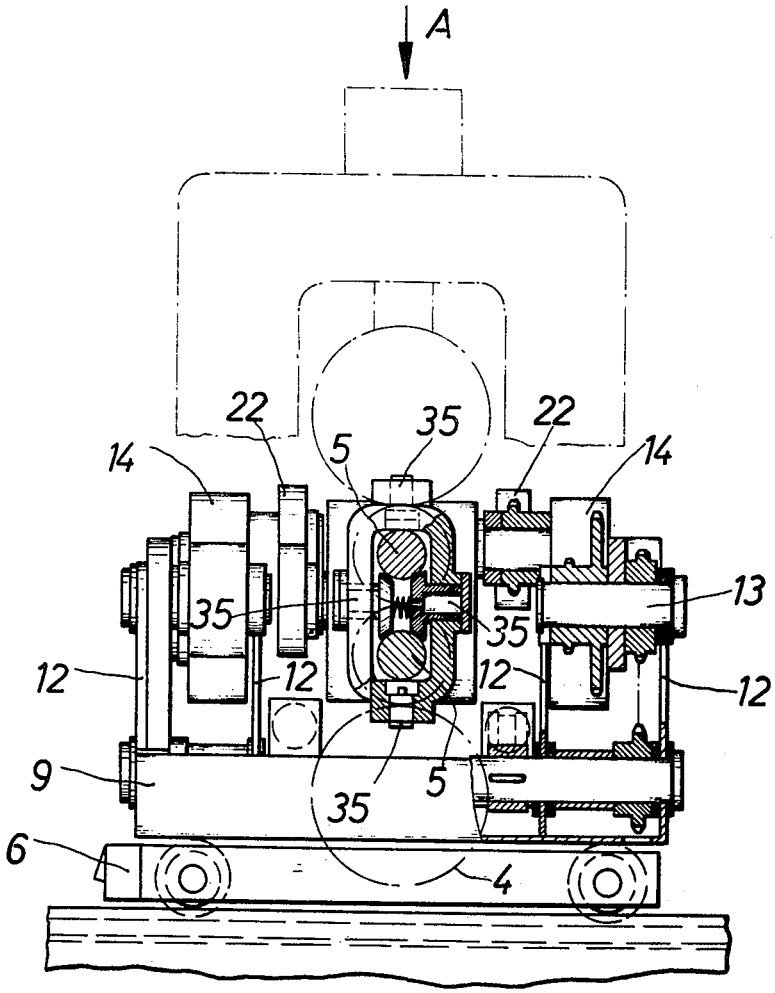
FIG. 2 is a section taken along lines 2 — 2 of FIG. 1, and partly in further section.
Figure 3:
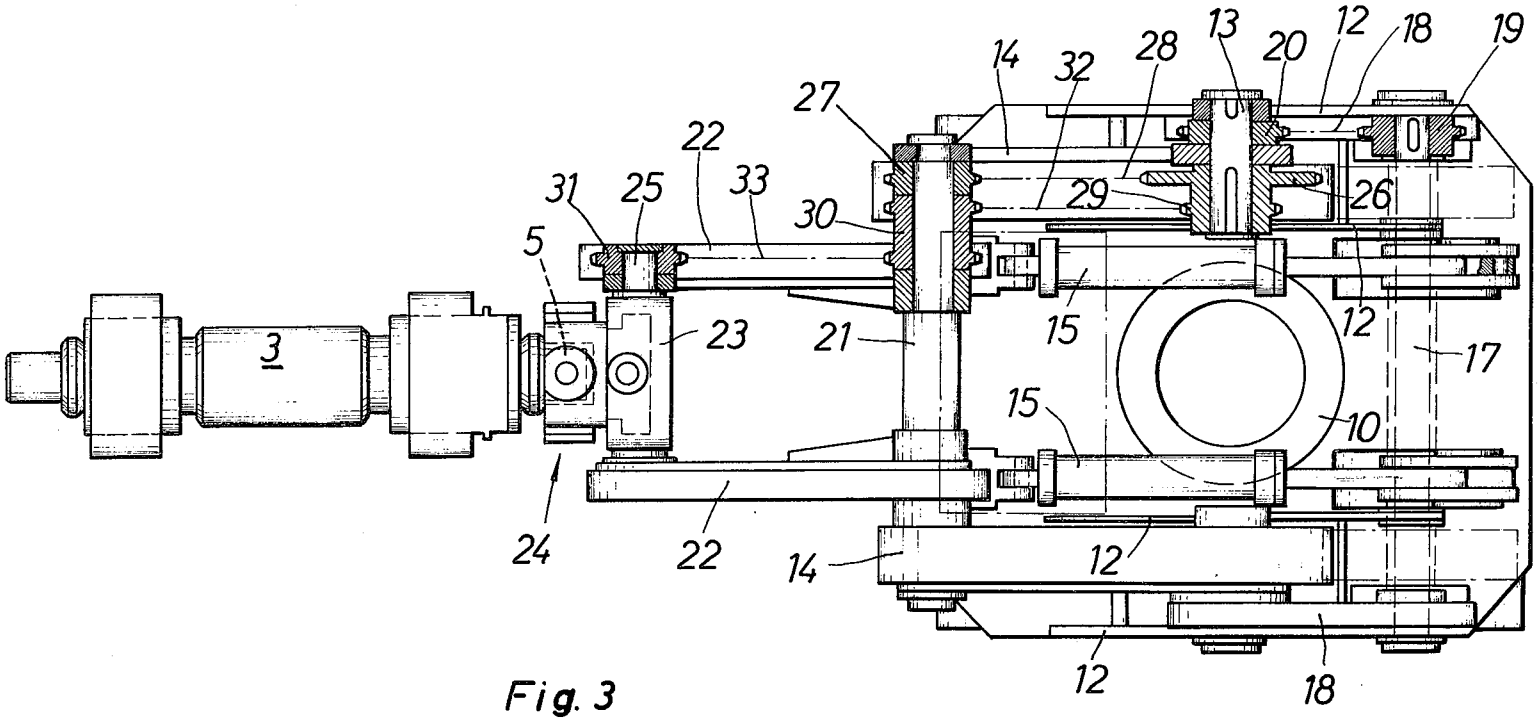
FIG. 3 is a top plan view of FIG. 1.

Referring now to FIGS. 1 – 3, a turn or swivel table 9 with a rotating bearing 10 is mounted on the transfer car 6, which can be turned about 180° by a hydraulic rotating drive 11.

Four pedestals or supports 12 are secured to the swivel table 9, in which supports two axles 13 are non-rotatably secured. An inner carrier arm 14 is rotatably mounted on each fixed axle 13. The rotatable or pivotal movement of the inner carrier arms 14 is brought about by hydraulic pivot drives, which respectively comprise a cylinder 15, a pivot lever 16, a pivot shaft 17, and chain drive 18 with sprocket wheels 19, 20 operatively connected together. The sprocket wheel 19 is non-rotatably disposed on the pivot shaft 17, whereas the sprocket wheel 20 is rotatably mounted on the fixed axle 13 and is connected with the inner carrier arm 14.

The front ends of the inner carrier arms 14 are mounted on a shaft 21 passing therethrough. Two outer carrier arms 22 are non-rotatably secured to this shaft 21, the front ends of the outer carrier arms 22 carrying a guide 23 for a clamping head or chuck means 24. The guide 23 of the clamping head 24 is supported with axle ends or trunnions 25 in the front ends of the outer carrier arms 22.

The pivot movement of the inner carrier arms 14 is transmitted to the outer carrier arms 22 by two cycloid transmissions. Each cycloid transmission or drive comprises a sprocket wheel 26 mounted on the fixed axle 13, and a sprocket wheel 27 rigidly mounted on the shaft 21, the radii of which are in the ratio of 2:1 and which are connected to each other by means of a chain drive 28. The two cycloid transmissions, constituting a kinematic connection between the carrier arms 14 and 22, cause the front ends of the outer carrier arms 22 to move in a straight line between the points $x - y$ (FIG. 1).

In order to be able to stop or secure the guide 23 of the clamping head 24 in the perpendicular or vertical position and thus simultaneously also the operating rollers 3 in the horizontal position with the movement of the carrier arms 14 and 22, straight line guide devices are provided in the carrier arms parallel to the cycloid transmissions. The straight line guide devices each comprise a sprocket wheel 29 rigidly disposed on the fixed axle 13, a twin-sprocket wheel 30 rotatably mounted on the shaft 21, and a sprocket wheel 31 rigidly disposed on the trunnion 25, which sprocket wheels are operatively connected with each other by means of chain drives 32 and 33.

Two single acting hydraulic setting cylinders 34 are provided in the guide 23 for the clamping head 24, by which the clamping head 24 can be adjusted to the exact height of the mounting trunnions 5 of the operating rollers 3.

In the clamping head itself there are arranged an upper and a lower, as well as two lateral, single acting clamping cylinders 35, the lateral clamping cylinders 35 each having two clamping seats substantially complementary to the periphery of the trunnions 5 of the rollers 3 (FIG. 2), by which they engage the upper and lower operating rollers 3.

Figure 5:
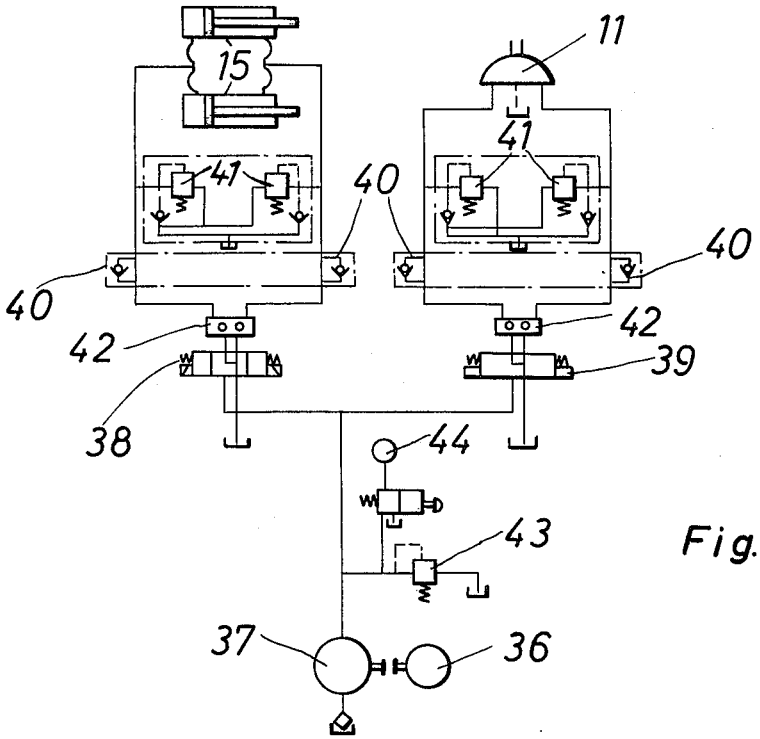
FIG. 5 is a hydraulic circuit diagram for the rotating drive and the drive of the carrier arms.

A hydraulic circuit diagram is illustrated in FIG. 5 for the rotating drive 11 of the turn table 9 and for the cylinders 15 for the movement of the carrier arms 14 and 22. The pressure oil is fed from a pump 37 driven by an electromotor 36 to the cylinders 15 and to the rotating drive 11, respectively, over two electromagnetic valves 38 and 39 which are to be actuated separately from each other. Throttles or throttles valves 40 are connected in series to the cylinders 15 and to the rotating drive 11, respectively, by which the speed of movement can be regulated. In addition, escape or by-pass valves 41 are connected in series to the cylinders 15 and to the rotating drive 11 in order to avoid a break of a hydraulic line in the event of locking or jamming of some moved machine parts. In order to stop or secure the cylinders 15 and the rotating drive 11, respectively, in the occurring respective position, relief or check valves 42 follow the electromagnetic valves 38, 39, which check valves 42 are opened only at a predetermined minimum pressure in the hydraulic system and immediately close with a break. Finally, still a pressure limit valve 43 and a manometer 44 are connected to the pressure line.

Figure 6:
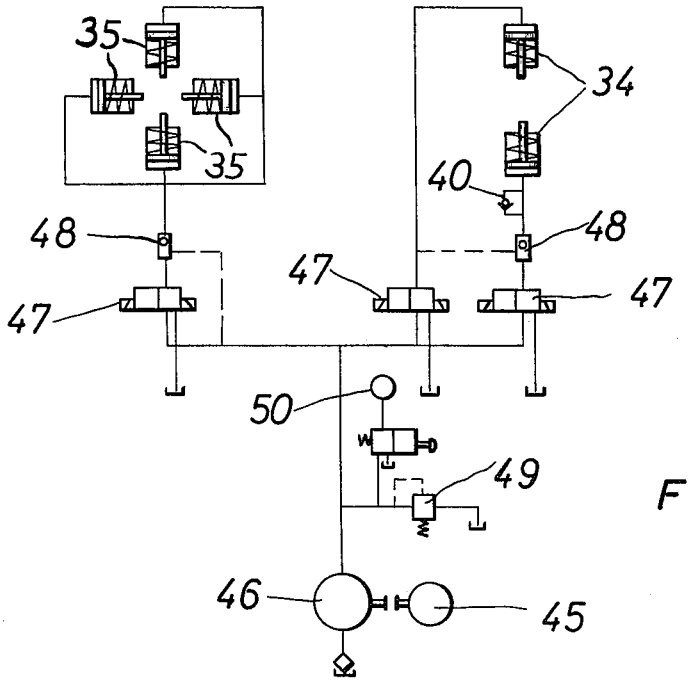
FIG. 6 is a hydraulic circuit diagram for the movement of the clamping head and the actuation of the clamping cylinder in the clamping head.

FIG. 6 shows a hydraulic circuit diagram for the adjusting cylinders 34 in the guide 23 and for the clamping cylinders 35 in the clamping head 24. A pump 46 driven by an electromotor presses the hydraulic medium in the clamping cylinders 34 and 35. Valves 47 which are to be actuated electromagnetically are interposed in the pressure line. So that the adjustment cylinders 34 as well as the clamping cylinders 35 are not able to release open in case of a break in the hydraulic line, also in this case check valves 48 are inserted in the pressure line, which are opened only at a predetermined pressure and immediately close with a break in the hydraulic system. Also in this case a pressure limit valve 49 and a manometer 50 are connected to the pressure line.

By the apparatus according to the invention, the "pilgrim step movement" 6' arising from the working pattern illustrated in FIG. 7 can be carried out. In this manner the operating rollers 3 which are arranged in a roll stand A to F, initially are somewhat lifted and withdrawn until their center of gravity lies substantially over the transfer car 6. Then the turn table 9 is rotated about 180° by the rotating drive 11, so that the operating rollers 3 can be deposited on the side of the rails 7 which is opposite to the roll stands A to F. The transfer car 6 then travels somewhat forward and takes on the new operating rollers **3*a*. The fresh operating rollers 3*a* then at first are again hauled over the transfer car 6, then the turn table is turned back 180°, the transfer car 6 again travels back to in front of the corresponding roll stand A – F, and then the fresh working rollers 3*a* can be pushed in the roll stand. The apparatus then travels with the transfer car 6 in front of the next roll stand A – F, where then the "pilgrim step movement" or "step back movement" of the next working cycle begins. The preceding described working cycle is repeated until the operating rollers 3** have been replaced on all roll stands A to F.

All new features mentioned in the specification and illustrated in the drawings are cooperatively important to the invention, also in so far as they are not expressly set forth in the claims, as they may be included under the doctrine of equivalents. While I have set forth one embodiment of the invention, it is to be understood that this embodiment is given by example only and not in a limiting sense.

I claim:

1. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, said coupling drive comprises, two pairs of said carrier arms arranged spaced from each other and parallel to each other, and each of said pairs of carrier arms includes said inner carrier arm and said outer carrier arm, pedestals spaced from each one another, fixed axles secured in said pedestals, respectively, said fixed axles being separated from each other, said inner carrier arms are supported on said fixed axles, respectively.

2. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, said coupling drive comprises, two pairs of said carrier arms arranged spaced from each other and parallel to each other, and each of said pairs of carrier arms, a common shaft disposed on said inner carrier arms, said outer carrier arms are secured to said common shaft, fixed axles respectively supporting said inner carrier arms, said cycloid transmission means comprises a cycloid drive operatively disposed between said outer carrier arm and said inner carrier arm of each of said two pairs of said carrier arms, said cycloid drives each comprises, a first sprocket wheel secured on one of said fixed axles, a second sprocket wheel secured on said shaft, a chain drive operatively connects said first and second sprocket wheels to each other, and said first and second sprocket wheels have radii in the ratio of 2:1 respectively.

3. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, hydraulic pivot drives operatively connected to said inner carrier arms and including, a pivot drive shaft, a pivot lever pivotally disposed on said pivot drive shaft, a hydraulic cylinder operatively connected to said pivot lever, a chain drive operatively connecting said pivot drive shaft to a corresponding of said inner carrier arms.

4. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, said coupling drive comprises, two pairs of said carrier arms arranged spaced from each other and parallel to each other, and each of said pairs of carrier arms, a common shaft disposed on said inner carrier arms, said outer carrier arms are secured to said common shaft, fixed axles respectively supporting said inner carrier arms, a guide means for said clamping means having guide trunnions disposed on said outer carrier arms, said straight line guide means for said clamping means, comprises for each of said pairs of carrier arms, a first sprocket wheel secured on one of said fixed axles, two sprocket wheels connected with each other, constituting a twin sprocket wheel, disposed on said shaft, a second sprocket wheel secured on one of said guide trunnions, chain drives connecting said first sprocket wheel with said twin sprocket wheel and the latter with said second sprocket wheel, said sprocket wheels having radii in the ratio of 1:1:1 respectively.

5. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, said clamping means includes an upper clamping cylinder, a lower clamping cylinder, and two lateral clamping cylinders therebetween for the clamping of the mounting journals of the rollers.

6. The apparatus as in claim 5 wherein said lateral clamping cylinders include clamping pistons, respectively, each having two clamping seats.

7. An apparatus for the insertion and removal of the rollers of a roll stand with a transfer car which is moveable in a direction of the rollers, the latter having mounting journals, comprising means for inserting the rollers into the roll stand and withdrawing the rollers from the roll stand, respectively, from a side thereof in a horizontal position of the rollers, comprising a coupling drive operatively disposed on said transfer car, said drive comprising at least two equally long carrier arms, including an inner carrier arm and an outer carrier arm operatively connected thereto, the latter having a front free end, cycloid transmission means for operatively coupling said at least two carrier arms with each other, clamping means being disposed on said front free end of said outer carrier arm for clamping said mounting journals of said rollers in a horizontal position of said rollers for horizontal movement thereof, straight line guide means for said clamping means being disposed parallel to said cycloid transmission means on said carrier arms, a turn table rotatably mounted on said transfer car, said coupling drive is disposed on said turn table.

8. In an apparatus for the insertion and removal of the rollers of a roll stand by which the rollers are pushed into the roll stand and withdrawn from the roll stand, respectively, from a side thereof in a horizontal position of the rollers, with a transfer car which is moveable in a direction of the rollers, the latter having mounting journals, and a carrier device with a clamping head for clamping and moving of the rollers on their mounting journals, the carrier device being rotatable about a vertical axis, and a straight line guide device being coordinated to said carrier device, the improvement wherein said rotatable carrier device is arranged on the transfer car and includes two pairs of carrier arms arranged parallel to each other and spaced from each other, said pairs of carrier arms, respectively, comprise two equally long inner and outer carrier arms, cycloid transmission means for coupling said inner and outer carrier arms with each other, respectively, a common shaft supported on said inner carrier arms, said outer carrier arms receiving said clamping head, said outer carrier arms being secured to said common shaft, said carrier device includes supports as well as fixed axles, the latter being separated from each other and secured in said supports, said inner carrier arms are supported on said fixed axles, respectively, pivot drive means connecting each of said inner carrier arms.

9. The improvement, as set forth in claim 8, wherein said inner carrier arms are pivotal relative to said fixed axles, said inner carrier arms are pivotal relative to said common shaft and said outer carrier arms, said pivot drive means for pivoting said carrier arms about said fixed axles.

* * * * *

UNITED STATES PATENT AND TRADEMARK OFFICE

CERTIFICATE OF CORRECTION

PATENT NO. 3 979 939

DATED September 14, 1976

INVENTOR(S) CYRIL PAZDERKA

It is certified that error appears in the above-identified patent and that said Letters Patent are hereby corrected as shown below:

Claim 2, line 28:

after "arms" insert --includes said inner carrier arm and said outer carrier arm--;

claim 4, line 28:

after "arms" insert --includes said inner carrier arm and said outer carrier arm--

Signed and Sealed this

Sixteenth Day of November 1976

[SEAL]

*Attest:*

RUTH C. MASON
*Attesting Officer*

C. MARSHALL DANN
*Commissioner of Patents and Trademarks*